US006760928B1

(12) United States Patent
Rodriguez

(10) Patent No.: US 6,760,928 B1
(45) Date of Patent: Jul. 13, 2004

(54) SYSTEM AND METHOD FOR CONTROLLING TOILET ODORS

(76) Inventor: Cirilo Rodriguez, 412 Martin St., Athens, TX (US) 75751

( * ) Notice: Subject to any disclaimer, the term of this patent is extended or adjusted under 35 U.S.C. 154(b) by 0 days.

(21) Appl. No.: 10/308,348

(22) Filed: Dec. 3, 2002

(51) Int. Cl.[7] ..... E47K 13/00
(52) U.S. Cl. ..... 4/217; 4/347
(58) Field of Search ..... 4/217, 216, 218, 4/213, 209, 222.1, 239, 347–352

(56) References Cited

U.S. PATENT DOCUMENTS

| | | | | | |
|---|---|---|---|---|---|
| 1,911,032 | A | * | 5/1933 | Minkler | 4/213 |
| 2,110,956 | A | * | 3/1938 | Horbetz | 4/213 |
| 3,295,147 | A | * | 1/1967 | Meyer | 4/213 |
| 3,733,619 | A | * | 5/1973 | Smith | 4/213 |
| 3,916,459 | A | | 11/1975 | Ivancevic | |
| 4,175,293 | A | | 11/1979 | Stephens et al. | |
| 4,701,966 | A | | 10/1987 | Schafer | |
| 4,872,398 | A | * | 10/1989 | Shen | 454/346 |
| 5,355,536 | A | | 10/1994 | Prisco | |
| 5,452,481 | A | | 9/1995 | Meyer | |
| 5,454,122 | A | * | 10/1995 | Bergeron | 4/217 |
| 5,685,023 | A | * | 11/1997 | Alston | 4/239 |
| 5,724,682 | A | * | 3/1998 | Johnson | 4/217 |
| 6,131,210 | A | * | 10/2000 | Coca | 4/213 |
| 6,237,163 | B1 | | 5/2001 | Guzzo et al. | |
| 6,298,500 | B1 | * | 10/2001 | Sollami | 4/217 |
| 6,449,778 | B1 | * | 9/2002 | Franco | 4/217 |
| 6,526,598 | B1 | * | 3/2003 | Black | 4/217 |
| 6,567,994 | B1 | * | 5/2003 | Spurr et al. | 4/217 |
| 6,678,900 | B2 | * | 1/2004 | Ware | 4/213 |

FOREIGN PATENT DOCUMENTS

GB 2233679 A * 1/1991

OTHER PUBLICATIONS

Definition of Exponential Functions; obtained from http://www.sosmath.com/algebra/logs/log4/log4.html.*

* cited by examiner

*Primary Examiner*—Gregory L. Huson
*Assistant Examiner*—Khoa Huynh
(74) *Attorney, Agent, or Firm*—Daniel R. Brown

(57) ABSTRACT

A system and method for controlling toilet odors. A toilet seat having a tapered vent passage formed therein, for causing a gradual increase in flow velocity there through is coupled to a conduit, which is further coupled to a fan. The fan induces air flow through the vent passage and the conduit, thereby exhausting air away from the toilet. Low volume and air flow rates are employed to effectively and quietly remove objectionable odors from the toilet area during use. An inlet screen may be positioned over the inlet end of the vent passage. The fan power may be controlled with a seat-activated switch. The conduit may be a corrugated hose.

32 Claims, 8 Drawing Sheets

Section A-A

Section B-B

SYSTEM AND METHOD FOR CONTROLLING TOILET ODORS

BACKGROUND OF THE INVENTION

1. Field of the Invention

The present invention relates to ventilated toilets. More specifically, the present invention relates to ventilated toilet seats that use controlled airflow to effectively remove odors.

2. Description of the Related Art

Certain configurations of ventilated toilets are known in the art. U.S. Pat. No. 6,237,163 to Guzzo et al. teaches a ventilated toilet seat that employs an annular duct formed within a toilet seat that has plural openings, which draw air from under the seat. A wall-mounted switch controls a fan that draws air through the seat. U.S. Pat. No. 5,355,536 to Prisco teaches a configuration somewhat similar to Guzzo et al. in that Prisco teaches a hollow toilet seat with plural openings disposed about the inner side surfaces of the toilet seat opening. A wall-mounted switch controls a fan that draws air through the seat. U.S. Pat. No. 5,452,481 to Meyer teaches a vent system that fits between a toilet seat and the toilet bowl that employs a hollow intake portion placed near the rear of the toilet bowl. An air duct connects the intake portion to a fan, which is controlled by a wall-mounted switch to evacuate air from the vicinity of the toilet bowl. Similarly, U.S. Pat. No. 4,701,966 to Schafer, U.S. Pat. No. 4,175,293 to Stephens et al., and U.S. Pat. No. 3,916,459 to Ivancevic all teach single vent openings located either between the toilet bowl and the toilet seat, or located within the toilet seat that are coupled through some sort of air duct to a fan that evacuates air from the area of the toilet in an effort to reduce toilet odors.

In view of this prior art, it would appear that the problem of removing odors from the vicinity of toilets has been satisfactorily addressed by the art. Yet, a survey of commercially available systems and methods for removal of odor from bathrooms will quickly reveal that the predominant approach to removal of toilet odors is still the well known vent or fan implemented to remove air from the entire bathroom in which a toilet is located. This approach is unsatisfactory because of the time it takes a room ventilating fan to clear a bathroom of all objectionable odors. The aforementioned prior art patents would seem to address the problem by placing the exhaust vent opening near the physical source of odors, yet such systems are not readily commercially available.

What the prior art generally teaches is to place a vent opening near the physical source of toilet odors and to draw air away in an effort to remove the odors from the bathroom before odors spread to the entire environment of the bathroom. However, the prior art attempts have failed for several reasons. The prior art fails because the systems taught do not effectively remove all the odors produced. The prior art fails because some prior art attempts are overly complex and therefore not commercially feasible. The prior art fails because it has not addressed the subtle details and issues related to toilet geometry and the physiological aspects of odor production. And, the prior art fails because it has not dealt with the quietness and comfort issues which arise when an exhaust fan vent is placed in close proximity to a toilet and toilet seat. Thus there is a need in the art for a system and method of bathroom odor removal that overcomes the disadvantages in the prior art.

SUMMARY OF THE INVENTION

The need in the art is addressed by the systems and methods of the present invention. A system for removing odor by exhausting air from a toilet is taught. The system includes a toilet seat that has a vent passage formed therein. The vent passage is tapered and this causes air flow there through to increase in velocity from an inlet end to an outlet end. A conduit that has a first opening is coupled to the outlet end of the vent passage. A second opening in the conduit is coupled to a fan, which induces air flow through the vent passage and the conduit, thereby exhausting air away from the toilet.

Specific embodiments are taught which add various refinements to the system. In one embodiment, the vent passage is formed to so as to promote and yield laminar air flow through the passage. The taper may be shaped to follow an exponential function. Air velocity is controlled by the size of the inlet, and a specific embodiment uses an inlet that has an area that yields air flow velocity of approximately one foot per second. In another embodiment, the inlet has an area that yields air flow velocity of less than two feet per second. In another embodiment, the inlet opening has an area of approximately five square inches.

In another embodiment, plural vent passages are formed in the toilet seat, which are sized proportionately. The vent passage may located at the rear of the toilet seat, or may be located adjacent to a hinge on the toilet seat. The inlet end of the vent passage may be disposed upon the inner rim of the opening on the toilet seat, or may be disposed on the inner rim and bottom of the toilet seat. In one embodiment, an inlet screen positioned at the inlet end. The inlet screen may conform to the shape of the toilet seat, and may be formed from perforated plate. In a specific embodiment, the conduit is a flexible duct. To aid flexibility and noise abatement, the flexible duct may be corrugated.

In certain embodiments, the fan is used to induce controlled air flow rates. In one embodiment, the fan induces an air flow rate of less than twenty-four cubic feet per minute. In another embodiment, fan produces an air flow rate of approximately twelve cubic feet per minute. Various fan configurations can be applied, and in one embodiment the fan is a squirrel cage blower. A switch can be added that is coupled to activate the fan. The switch may be disposed upon the toilet seat so as to actuate when a user sits upon the toilet seat. In a specific embodiment, a child-sized secondary toilet seat positioned over the toilet seat.

The present invention also teaches a method for removing odors from a toilet. The toilet having a toilet seat with a vent passage, with an inlet end and an outlet end, formed therein. The method includes the steps of inducing an air flow of increasing velocity from the inlet end to the outlet end of the vent passage, and exhausting the induced airflow to a space away from the toilet.

There are also specific refinements taught with respect to the foregoing method. In one embodiment, the vent passage is formed as a taper to yield laminar air flow there through. The taper may follow an exponential function. In another embodiment, the air flow velocity at the inlet end is approximately one foot per second. In a specific embodiment, the air flow velocity at the inlet end is maintained at less than two feet per second. Air flow velocity is also controlled by selection of the inlet end opening. In one embodiment, the inlet end has an area of approximately five square inches. The inlet end may be disposed upon the inner rim of the opening on the toilet seat, or may be disposed on the inner rim and bottom of the toilet seat.

In another specific embodiment of the methods taught, the exhausting step is accomplished through a conduit. The inducing step may be accomplished with a fan. In one embodiment, the air flow is less than twenty-four cubic feet per minute. In a particular embodiment, the air flow of approximately twelve cubic feet per minute. Control of the air flow can be accomplished by activating the air flow when a user sits upon the toilet seat. Activation can be accomplished with a switch connected to the toilet seat.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention overcomes the problems in the prior art with a system and method that has been created through design and empirical testing to produce results that are effective, low cost, simple, non-invasive, and comfortable. The present invention is suitable for both retrofit and new construction, and can be accomplished by both tradesmen and unskilled consumers alike. A basic configuration illustrative embodiment appears in FIG. 1. Because the source of toilet odors emanate from the immediate vicinity of the toilet bowl during use, the present invention draws air and odors away from the toilet bowl during use, thus preventing odors from propagating away from the toilet and contaminating the bathroom environment. The air drawn away from the toilet is exhausted to an area away from the bathroom environment, such as unused attic space or outdoors, for example.

Figure 1:
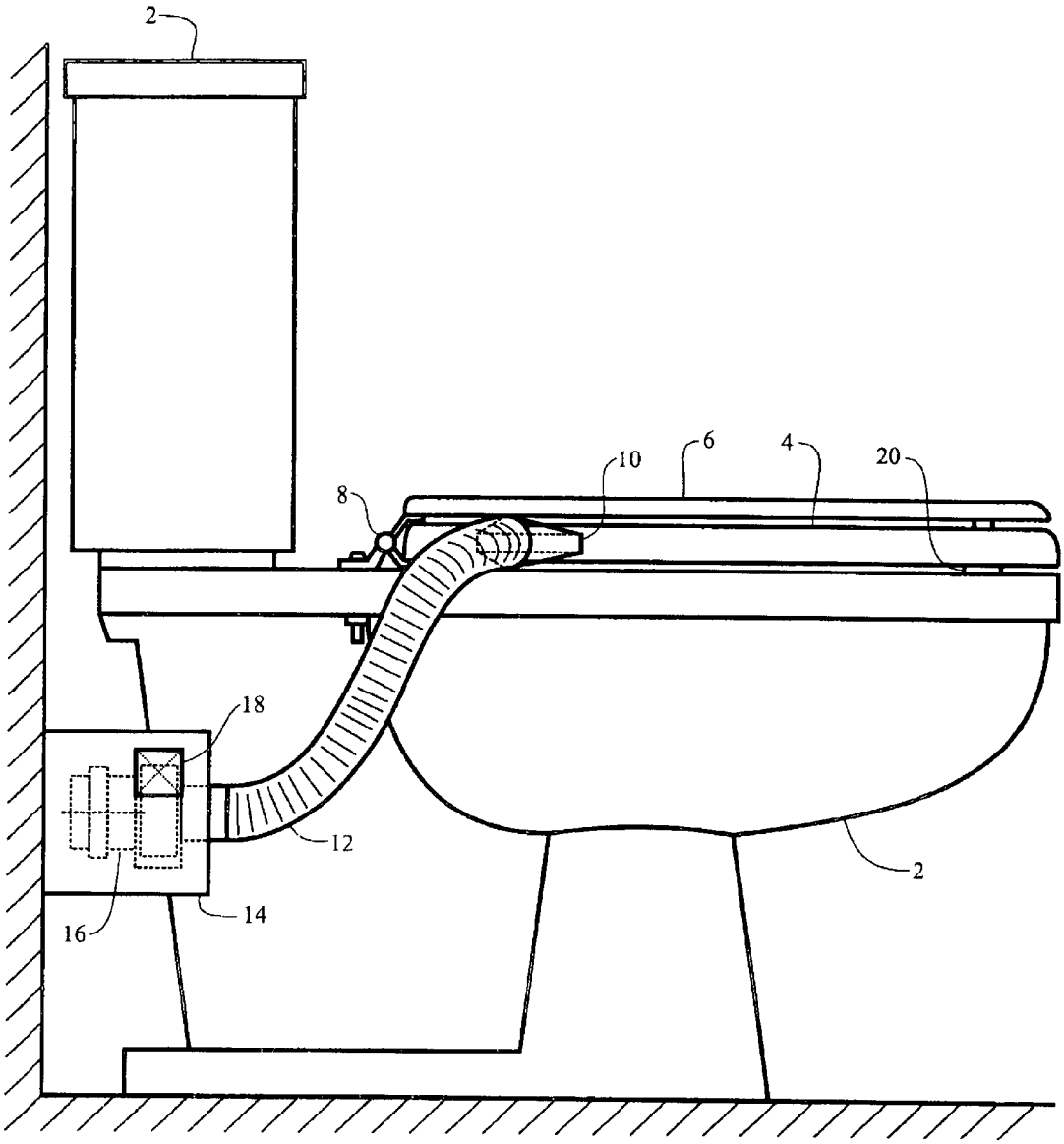
FIG. 1 is a side view of a toilet employing a toilet seat in an illustrative embodiment of the present invention.

FIG. 1 illustrates a toilet 2 that has a toilet seat 4 and a seat cover 6 attached thereto by hinges 8. Note that a gap exists between the toilet bowl 2 and the toilet seat 4, the gap size being defined by the height of toilet seat foot 20. Those skilled in the art are familiar with such a configuration. In the illustrative embodiment, a vent passage is formed into the toilet seat 4, which is coupled to a conduit 12 with a conduit transition 10. Essentially, the conduit transition 10 adapts the shape and size of the conduit 12 to that of the vent passage outlet end (not shown in FIG. 1). In the illustrative embodiment, the conduit 12 is a flexible hose and the conduit transition 10 is a round to rectangular hose transition. The hose 12 is coupled through a fan enclosure 14, which houses a fan 16. The fan 16 induces air flow be creating a suction at the fan's inlet that draws air through the vent passage in the toilet seat 4, through the hose transition 10, and through the hose 12. The fan has an exhaust opening 18, which is coupled through a wall of the bathroom enclosure to an open space, as noted above.

Figure 2:
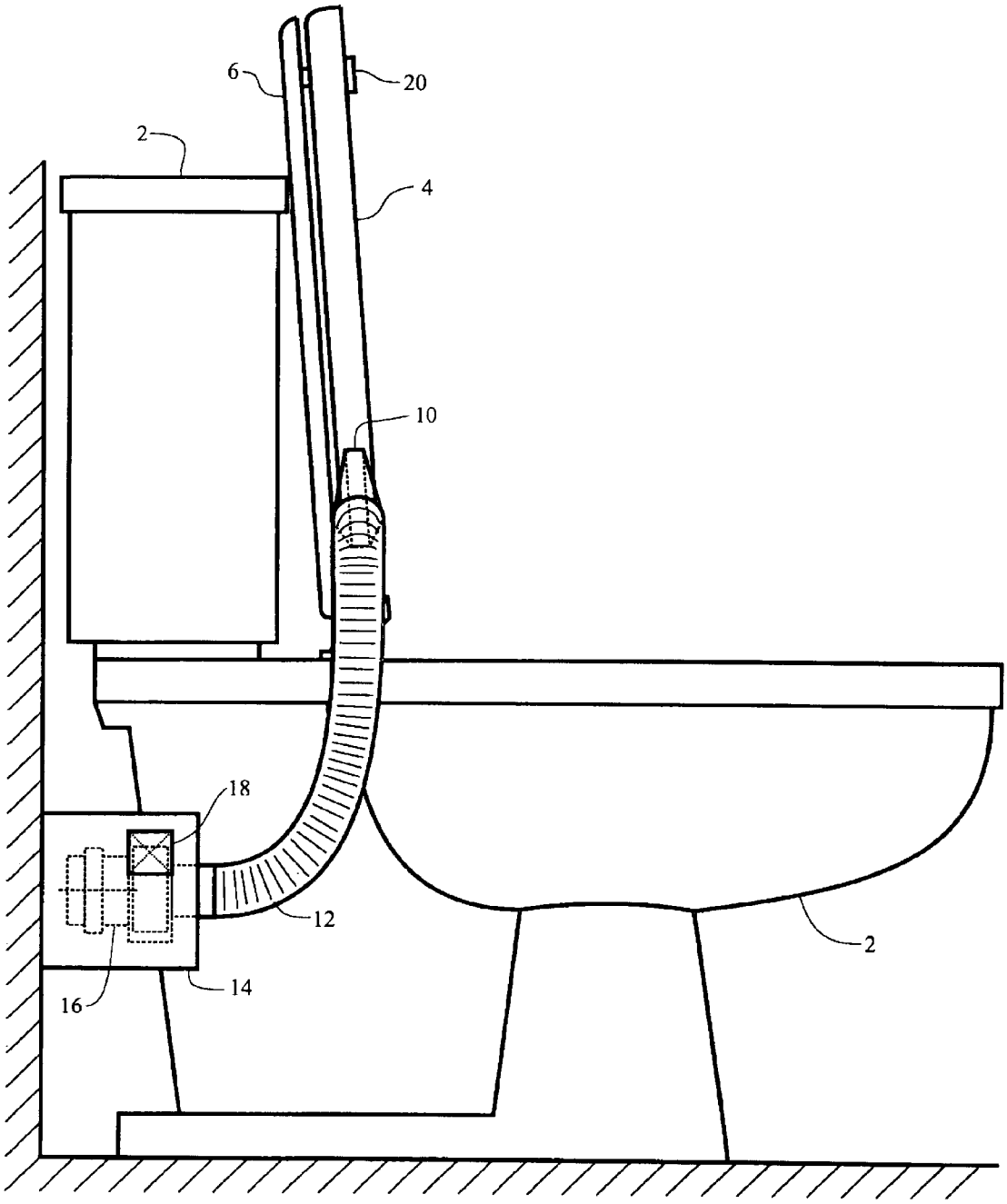
FIG. 2 is a side view of a toilet employing a toilet seat in an illustrative embodiment of the present invention.

Toilet seats are typically hinged, as illustrated in FIG. 1 by hinge 8, so that the toilet seat cover 6 and toilet seat 4 can be lifted during routine use and for cleaning. Attention is directed to FIG. 2, which illustrates the toilet 2 with the toilet seat cover 6 and toilet seat 4 in the raised position. Note that the fan 16, fan housing 14 and toilet 2 do not move as the toilet seat 4 is raised. Hose 12 is flexible and provides the needed articulation for preventing interference with toilet seat operation. In the illustrative embodiment, a corrugated flexible plastic or rubber hose 12 is used. Such a hose is low cost and lightweight, and has adequate flexibility as required. In addition, it has been determined that the corrugated hose absorbs sound created by the fan 16 during operation. Quiet operation is a useful and important benefit of the present invention in that users of the present invention are not annoyed, put-off, or confused by sound and vibration produced during operation of the fan and the odor removal system.

Figure 3:
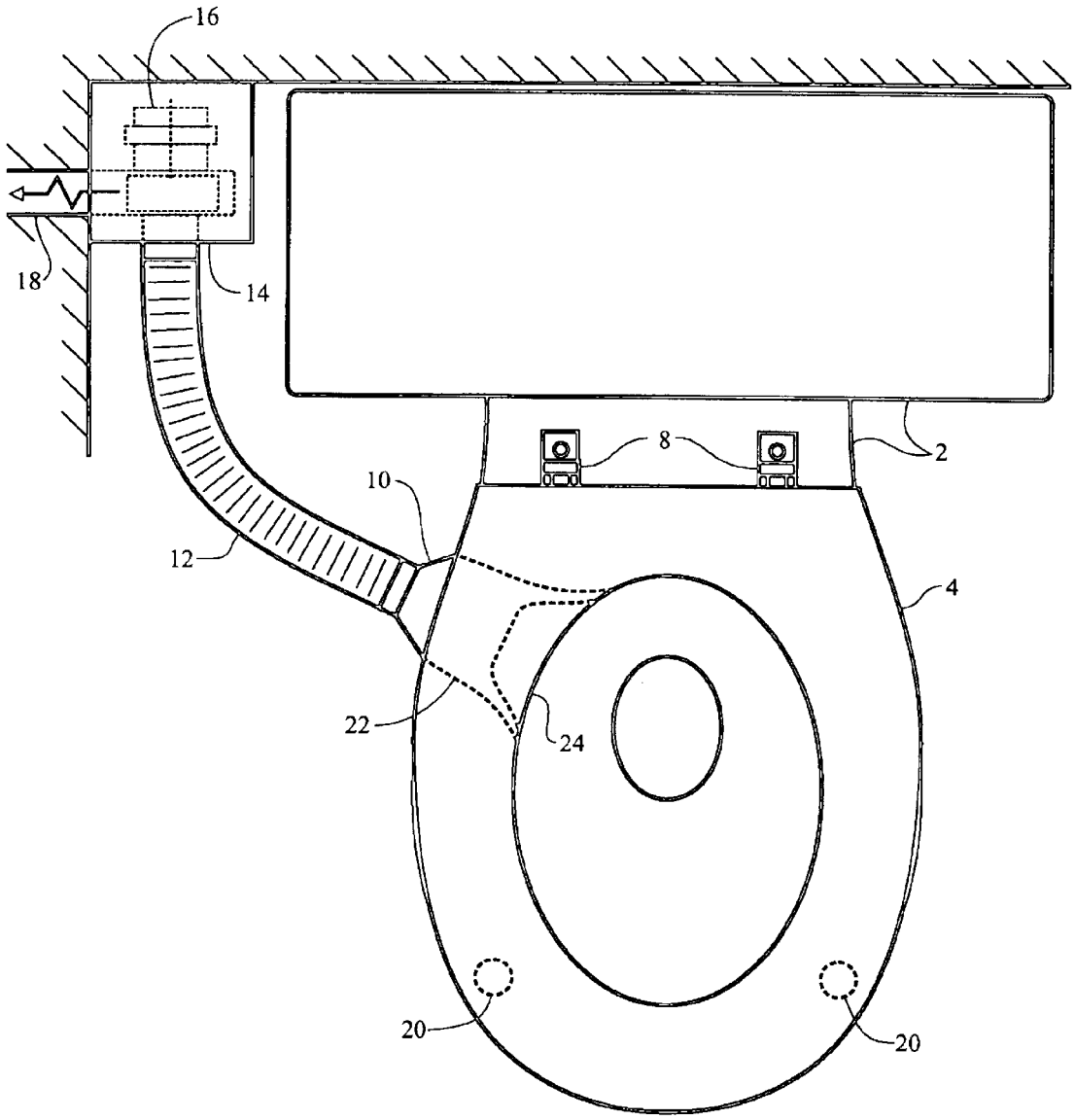
FIG. 3 is a top view of a toilet employing a toilet seat in an illustrative embodiment of the present invention.

Reference is directed to FIG. 3, which is a top view of the toilet 2 employing an odor removal system in an illustrative embodiment of the present invention. The toilet 2 is visible with the toilet seat 4 connected by hinges 8 and supported by toilet seat feet 20. In FIG. 3, the vent passage 22 is clearly visible, as is the conduit, or hose, transition 10. The hose 12 is coupled to the fan enclosure 14, where the fan 16 exhausts through the bathroom wall 18. The vent passage 22 is tapered from and inlet end 24 to and outlet end, which couples directly to hose transition 10. The tapered design of vent passage 22 is a key feature of the present invention. The taper allows the inlet end 24 of the vent passage to accept air flow at a lower velocity, while allowing the velocity to increase as the air passes through vent passage 22 and conduit transition 10. Thus, the air drawn from the toilet bowl occurs at a lower velocity than the velocity of the air as it flows through conduit 12.

Air flow volume and velocity are important aspects of the present invention. The prior art vented toilet designs employed typical bathroom exhaust fans. Such fans are known to those skilled in the art to produce air flow rates of 60 cubic feet per minute to over 250 cubic feet per minute. While high air volume removal may seem advantageous to removal of odors, it has been determined through empirical testing that this is not necessarily the case. The reality is that the volume of noxious gases produced during use of a toilet is remarkably low. High volume exhaust air flow rates lead to air turbulence and striated air flows. Turbulent and non-laminar air flow does not fully and efficiently evacuate the toilet bowl area, and allows noxious gases to escape from the toilet area during use, leading to the undesirable result of lingering bathroom odors. Empirical testing has shown that relatively low air flow rates perform better. In the illustrative embodiment, air flow volumes are maintained below about twenty-four cubic feet per minute. In the preferred embodiment, an air flow rate of about twelve cubic feet per minute is employed. The low air flow rate is maintained through use of a small, low power, fan. Incidentally, such fans can have lower purchase and operating costs than the larger, more powerful, fans applied in the prior art. The preferred embodiment fan is also quieter by virtue of the lower volume requirements.

In the preferred embodiment, a Dayton model 7002-0127 centrifugal blower is used as fan 16. This product is available from W. W. Grainger, Inc. as Grainger stock number 4C759. See also www.grainger.com on the Internet. The fan employs a shaded pole 120-volt ac motor and a squirrel cage impeller and housing configuration that produces twelve cubic feet per minute air flow at 0.0" of static pressure and nine cubic feet per minute air flow at 0.1" of static pressure. In the illustrative embodiment, the system operating pressures are maintained at nearly 0.0" of static pressure. This volume of air, in combination with the vent passage 22 and inlet opening 24 configurations, taught herein, has been proven to be highly effective at evacuating noxious gases and odors from a toilet during use.

Figure 4:
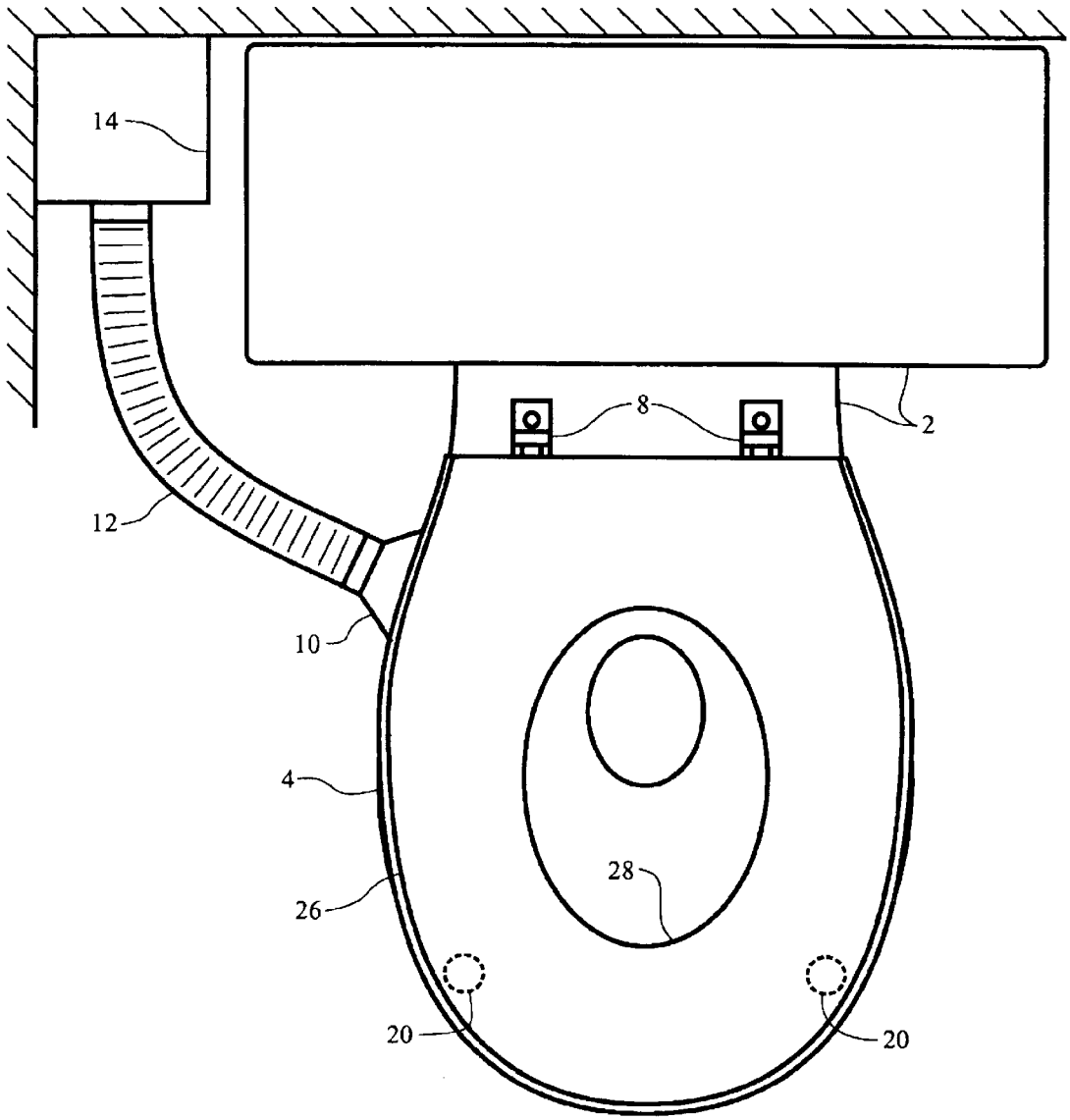
FIG. 4 is a top view of a toilet employing a toilet seat in an illustrative embodiment of the present invention.

Reference is directed to FIG. 4, which is a top view of a toilet employing an illustrative embodiment of the present invention. In particular, the toilet 2 in FIG. 4 has a child-sized toilet seat 26 positioned above the adult-sized toilet seat 4. Both seats are coupled to the toilet 2 by hinges 8. The fan and housing 14 draw air through conduit 12 from the vent passage (not shown) and conduit transition 10 in the adult-sized toilet seat 4. The child-sized toilet seat 26 has a proportionately smaller seat opening 28 that is supported by toilet seat feet 20. A seat cover may optionally be positioned above the child-sized toilet seat 26.

Figure 5:
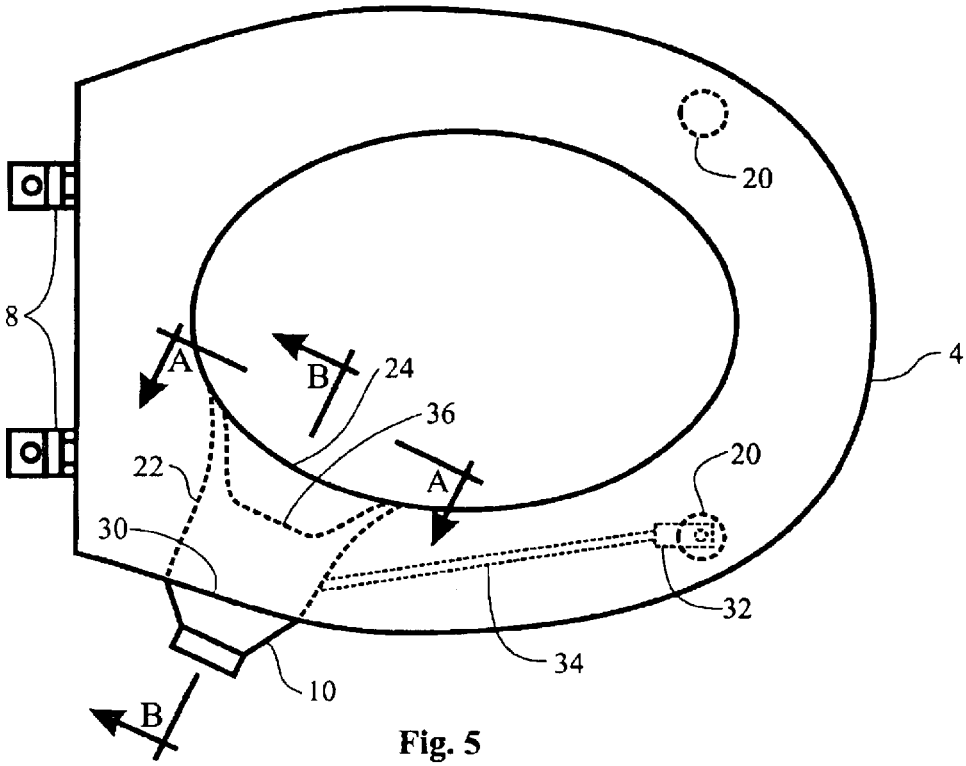
FIG. 5 is detail view of a toilet seat in an illustrative embodiment of the present invention.
Figure 6:
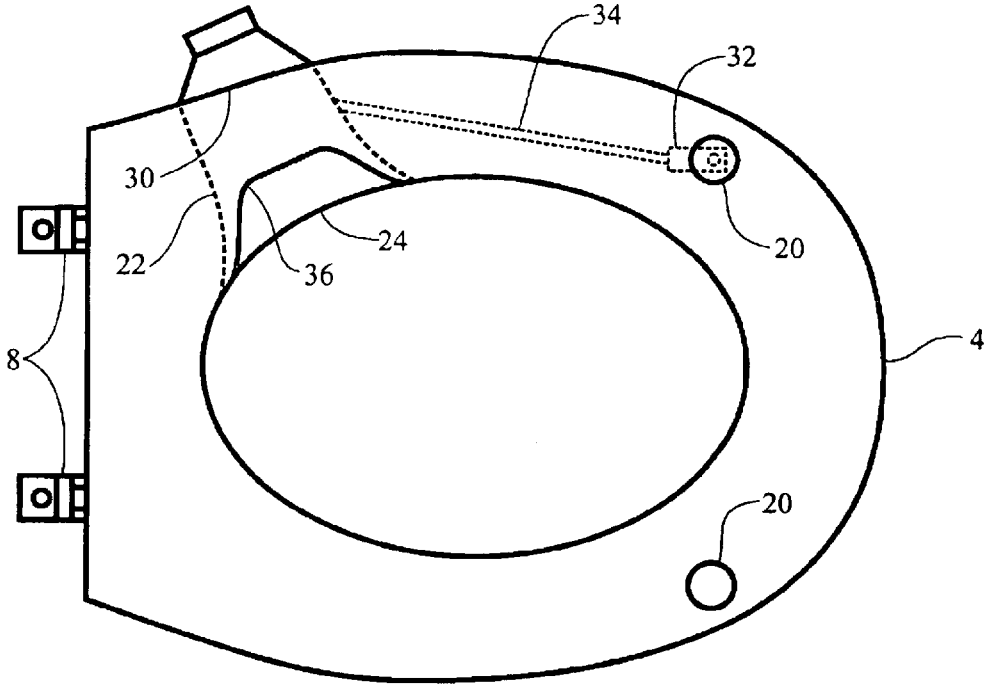
FIG. 6 is detail view of a toilet seat in an illustrative embodiment of the present invention.

Reference is now directed to FIG. 5 and FIG. 6, which are detailed top and bottom views, respectively, of a toilet seat in an illustrative embodiment of the present invention. The toilet seat 4 has hinges 8 attached to the rear of the seat 4. The seat has an inner and outer rim, in addition to the top and bottom surfaces. Two toilet seat feet 20 support the seat 4 over the toilet bowl (not shown). The vent passage 22 is formed within the material of the toilet seat 4. The vent passage 22 has an inlet end 24 and an outlet end 30. The outlet end 30 is coupled to the conduit transition 10. The taper of the vent passage 22 is smooth and regular so as to promote laminar air flow there through. The passage tapers from a larger area at the inlet end 24 to a smaller area at the outlet end 30. This taper results in a gradual increase in air flow velocity through the vent passage. The profile of the taper may follow an exponential function, such as a hyperbolic, parabolic, or other functions, as are known to those skilled in the art. The bottom surface of the toilet seat is removed according to line 36, which aides in the transition of relatively still air n the toilet bowl to the gradual increase in velocity experienced within the vent passage 22.

In the illustrative embodiment, 1½" diameter hose is used for the conduit that is coupled to conduit transition 10. The cross sectional area of the hose interior is therefore 1.8 square inches. With 12 cubic feet per minute of air flow, and given some resistive losses in air volume, the air velocity in the hose is approximately 3 feet per second. The conduit transition 10 transitions the 1½ inch diameter of the hose to a 3 inch by 0.6 inch rectangle, which also has a cross sectional area of about 1.8 square inches. The taper of the vent passage increases the cross sectional area of the passage to approximately 5 square inches at the inlet end. Thus, there is an about 1 to 3 increase in area and corresponding 3 to 1 decrease in velocity. Therefore, the inlet end air flow velocity is approximately one foot per second. This velocity and volume have shown to be highly effective at removing odors. Volumes below 24 cubic feet per minute are preferred, with 12 cubic feet per minute being near optimum. Air flow rates below 2 feet per second are preferred, with 1 foot per second being near optimum.

Another aspect of the present invention is the simple and quiet operation of the system. Ideally, the system would be unnoticed by users. The small, quiet, and low volume fan is a part of the unobtrusive nature of the system. So too, is the corrugated hose, which as a muffling effect on fan noise. The location of the vent passage at the rear or sides of the toilet seat near the hinges is preferred for both operational and convenience reasons. Being near the hinge, the hose does not flex very far when the seat is raised and lowered. Being near the rear of the seat has empirically shown to be most effective at removing odors. The flexible conduit hose aids in the simple operation and easy retrofit to existing toilets. The fan in the illustrative embodiment need not run continuously. It is only needed during actual use of the toilet. This goal can be achieved in at least three different ways. First of all, a simple power switch can be placed in the bathroom that is manually operated by the user to power the fan during use of the toilet. Second, the fan power switch can be operated simultaneously with a light switch in the bathroom. As many users turn on the bathroom light when they enter the room and then turn it off when they leave, the fan in the present invention can be effectively operated simultaneously with the light switch. A third way of powering the fan is to implement a power switch that is activated when the user sits upon the toilet seat 4. In FIG. 5 and FIG. 6, the toilet seat foot 20 is fitted with a spring operated momentary contact switch 32 that is actuated by the weight of a user sitting upon the toilet seat 4. A channel 34 is formed into the toilet seat 4 and is used to route the power wires from the switch to the interior of the vent passage 22. From the vent passage 22, the wires run inside the hose (not shown) down to the fan enclosure (not shown) where the switch is coupled in circuit to the fan power supply. A low voltage control circuit can be employed to eliminate the requirement of running high voltages into the toilet seat 4.

Figure 7:
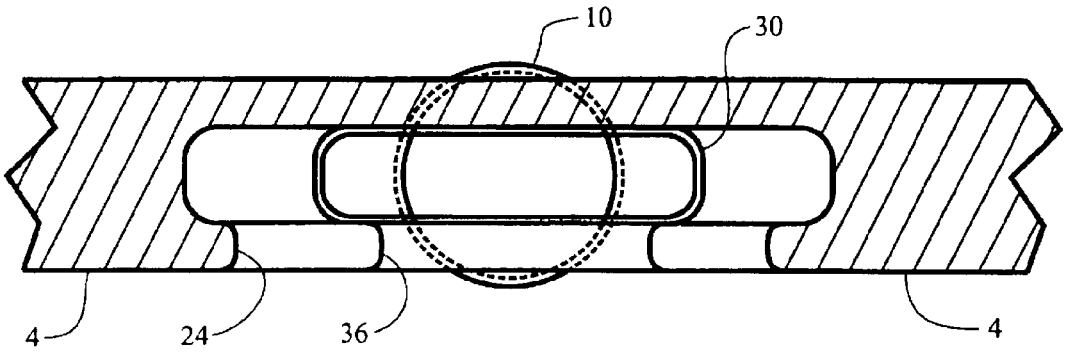
FIG. 7 is a section view of the air inlet of a toilet seat in an illustrative embodiment of the present invention.
Figure 8:
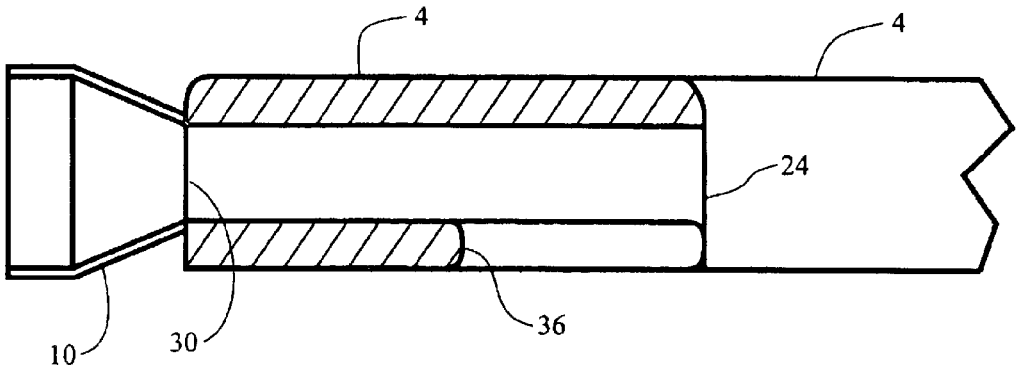
FIG. 8 is a section view of the air inlet of a toilet seat in an illustrative embodiment of the present invention.

Reference is direct to FIG. 7 and FIG. 8, which illustrate cross section views of the vent passage in a toilet seat in an illustrative embodiment of the present invention. FIG. 7 illustrates a section view taken along section line 'A—A' from FIG. 5. Thus, FIG. 7 is a view looking into the inlet end 24 of the vent passage 22. A portion of the toilet seat 4 is visible, and the conduit transition 10 is seen beyond. The inlet end 30 is visible as a smaller rectangular area that corresponds to the rectangular end of the conduit transition 10. The inlet end 24 is larger, by virtue of the aforementioned taper. The bottom of the toilet seat 4 is cut-away along area 36, and this allows air to be drawn from the bottom of the toilet seat as well as the inner rim. FIG. 8 is a view along section line 'B—B' from FIG. 5. The toilet seat 4 is visible in partial section. The conduit transition 10 also appears in section. The outlet end 30 and inlet end 24 are noted. The cut-away 36 on the bottom of the toilet seat 4 is plainly visible. Note that all of the edges and surfaces are formed as smooth transitions so as to promote laminar air flow while creating a minimum of turbulence.

Figure 9:
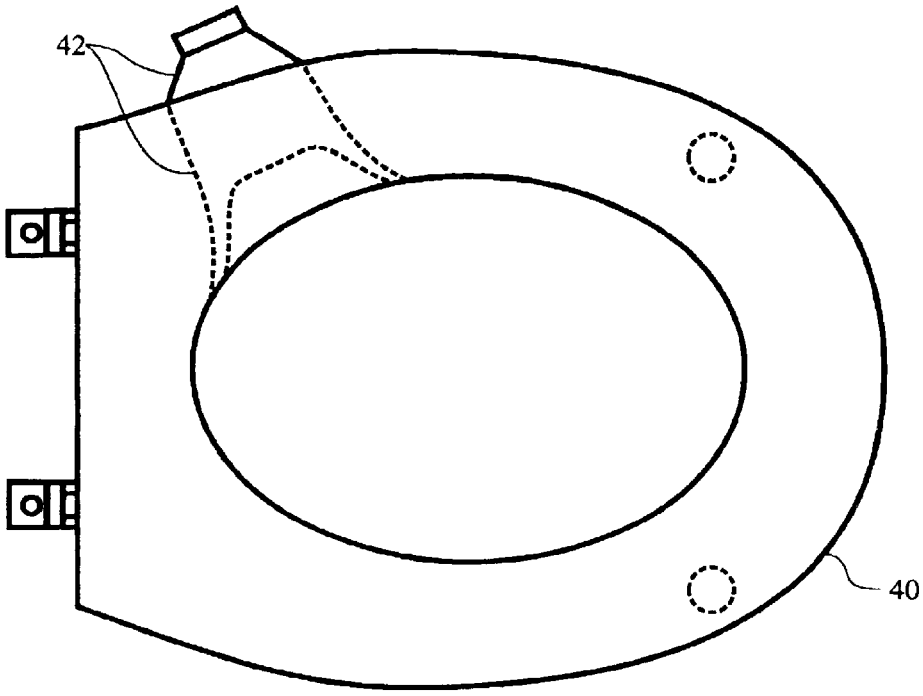
FIG. 9 is detail view of a toilet seat in an illustrative embodiment of the present invention.
Figure 10:
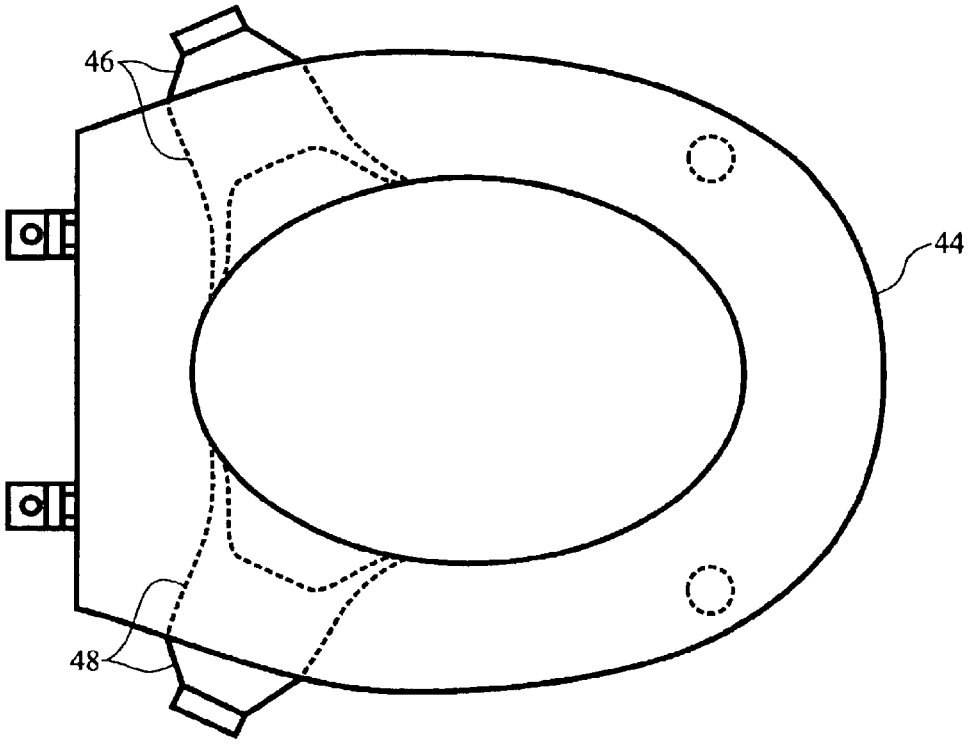
FIG. 10 is detail view of a toilet seat in an illustrative embodiment of the present invention.

Reference is directed to FIG. 9, which is an alternate embodiment of the present invention. A toilet seat 40 is configured with the vent passage and conduit transition positioned of the left-hand side of the toilet seat, instead of the right-hand side in the prior illustrative embodiments. Note that the exact position of the vent passage is not critical, but it is preferred that the vent passage be positioned near the back of the back of the sides of the toilet seat. FIG. 10 illustrates yet another illustrative embodiment of the present invention. A toilet seat 44 has a pair 46, 48 of vent passages and conduit transitions formed therein. This embodiment is effective for odor removal. The air flow volume is split between the two passages 46, 48, while the passages are adjusted in size to maintain the desired air flow volumes and velocities discussed herein before.

Figure 11:
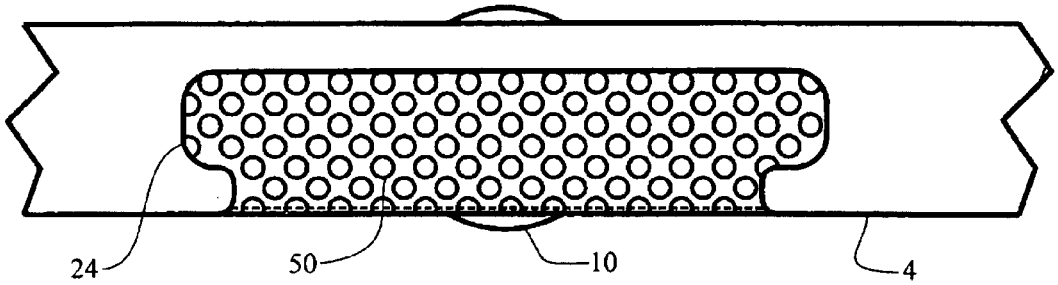
FIG. 11 is a detail view of an air inlet screen on a toilet seat in an illustrative embodiment of the present invention.
Figure 12:
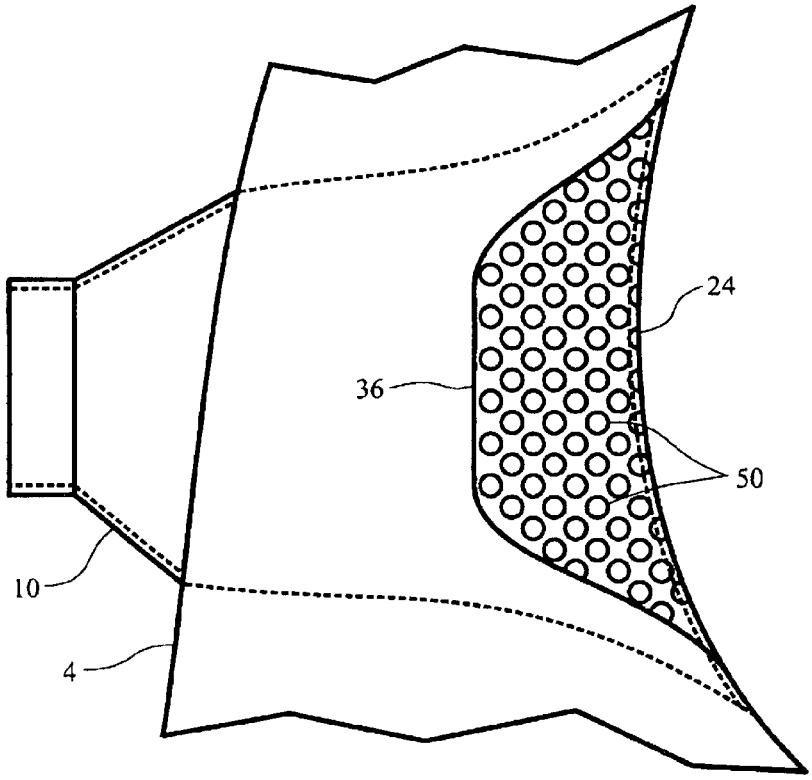
FIG. 12 is a detail view of an air inlet screen on a toilet seat in an illustrative embodiment of the present invention.
Figure 13:
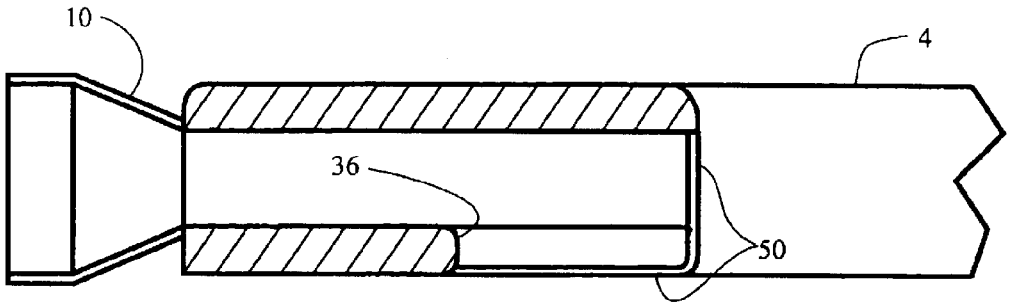
FIG. 13 is a detail view of an air inlet screen on a toilet seat in an illustrative embodiment of the present invention.

Another aspect of the present invention is the effect of drawing air away from a toilet. Even though the present invention employs relative low air velocities, light weight debris can be drawn into the air flow and accumulate in the system or adjacent to its ultimate exhaust point. To alleviate this issue, the present invention applies an inlet screen to the inlet end of the vent passage. FIG. 11, FIG. 12, and FIG. 13 are detail views of a toilet seat with a vent screen in place in an illustrative embodiment of the present invention. FIG. 11 is a detail view looking into the vent passage inlet end 24 of the toilet seat 4. The conduit transition 10 appears beyond. The vent screen 50 is a plastic plate that is perforated with plural holes, but could also be formed in many other configurations as desired by designers. The majority of the vent screen 50 is open area through which air can be drawn. This approach prevents the velocity through the individual holes, or openings, from becoming so great that undue noise will be created, or performance of the system degraded. FIG. 12 is a view of the bottom of the toilet seat 4. The conduit transition 10 is visible, as is the inlet end 24 of the vent passage. The vent screen 50 is shown to wrap around the bottom of the toilet seat 4 to cover the cutaway portion 36. Finally, FIG. 13 is a cross section of the toilet seat 4. The conduit transition 10 is visible, as is the cut-away portion 36 on the bottom of the toilet seat 4. The vent screen 50 is plainly visible and is shown to conform to the profile of the toilet seat 4.

Thus, the present invention has been described herein with reference to particular embodiments for particular applications. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A system for removing odor by exhausting air from a toilet, comprising:

a toilet seat having a vent passage formed therein defined by an upper wall surface, a lower wall surface and a pair of side wall surfaces, said pair of side wall surfaces being gradually tapered following an exponential function from an inlet end to an outlet end, such that said vent passage cross-sectional area gradually decreases from said inlet end to said outlet end which is substantially smaller in cross-sectional area than said inlet end, for causing air flow there through to increase in velocity; wherein a portion of said lower wall surface adjacent to said inlet end is removed, thereby enlarging the area of said inlet end;

a conduit having a first opening coupled to said outlet end, and a second opening;

a fan coupled to said second opening for inducing air flow through said vent passage and said conduit, thereby exhausting air away from the toilet.

2. The system of claim 1 wherein said vent passage is formed to yield laminar air flow there through.

3. The system of claim 1 wherein said inlet end has an area that yields an air flow velocity of approximately one foot per second.

4. The system of claim 1 wherein said inlet end has an area that yields an air flow velocity of less than two feet per second.

5. The system of claim 1 wherein said inlet area is of approximately five square inches.

6. The system of claim 1 wherein plural vent passages are formed in said toilet seat.

7. The system of claim 1 wherein said vent passage is located at the rear of said toilet seat.

8. The system of claim 1 wherein said vent passage is located adjacent to a hinge on said toilet seat.

9. The system of claim 1 wherein said inlet end is disposed upon the inner rim of the opening on said toilet seat.

10. The system of claim 1 wherein said inlet end is disposed on the inner rim and bottom of said toilet seat.

11. The system of claim 1, further comprising:

an inlet screen positioned at said inlet end.

12. The system of claim 11 wherein said inlet screen conforms to the shape of said toilet seat.

13. The system of claim 11 wherein said inlet screen is formed from perforated plate.

14. The system of claim 1 wherein said conduit is a flexible duct.

15. The system of claim 14 wherein said flexible duct is corrugated.

16. The system of claim 1 wherein said fan induces an airflow of less than twenty-four cubic feet per minute.

17. The system of claim 1 wherein said fan produces an air flow of approximately twelve cubic feet per minute.

18. The system of claim 1 wherein said fan is a squirrel cage blower.

19. The system of claim 1, further comprising:

a switch coupled to activate said fan, and that is and disposed upon said toilet seat to actuate when a user sits upon said toilet seat.

20. The system of claim 1, further comprising:

a child-sized secondary toilet seat positioned over said toilet seat.

21. A method for removing odors from a toilet having a toilet seat with a vent passage formed therein that is defined by an upper wall surface, a lower wall surface and a pair of side wall surfaces, said pair of side wall surfaces being gradually tapered following an exponential function from an inlet end to an outlet end, such that said vent passage cross-sectional area gradually decreases from said inlet end to said outlet end which is substantially smaller in cross-sectional area than said inlet end, and wherein a portion of said lower wall surface adjacent to said inlet end is removed, thereby enlarging the area of said inlet end, comprising the steps of:

inducing an airflow of gradually increasing velocity from said inlet end to said outlet end of said vent passage, and exhausting said induced airflow to a space away from the toilet.

22. The method of claim 21 wherein said airflow velocity at the inlet end is approximately one foot per second.

23. The method of claim 21 wherein said airflow velocity at the inlet end is less than two feet per second.

24. The method of claim 21 wherein the inlet area is of approximately five square inches.

25. The method of claim 21 wherein the inlet end is disposed upon the inner rim of the opening on the toilet seat.

26. The method of claim 21 wherein the inlet end is disposed on the inner rim and bottom of the toilet seat.

27. The method of claim 21 wherein said exhausting step is accomplished through a conduit.

28. The method of claim 21 wherein said inducing step is accomplished with a fan.

29. The method of claim 21 wherein said airflow is less than twenty-four cubic feet per minute.

30. The method of claim 21 wherein said air flow of approximately twelve cubic feet per minute.

31. The method of claim 21, further comprising the step of:

activating said air flow when a user sits upon the toilet seat.

32. The method of claim 31 wherein said activation step is accomplished with a switch connected to the toilet seat.

* * * * *